United States Patent [19]

Boyadjieff

[11] 4,023,449

[45] May 17, 1977

[54] TOOL FOR CONNECTING AND DISCONNECTING WELL PIPE

[75] Inventor: George I. Boyadjieff, Anaheim, Calif.

[73] Assignee: Varco International, Inc., Orange, Calif.

[22] Filed: Apr. 19, 1976

[21] Appl. No.: 678,403

Related U.S. Application Data

[63] Continuation-in-part of Ser. No. 550,776, Feb. 18, 1975, Pat. No. 3,961,399.

[52] U.S. Cl. ..... 81/57.16; 81/57.34; 81/57.35

[51] Int. Cl.[2] ..... B25B 17/00

[58] Field of Search ..... 81/57.16, 57.35, 57.34

[56] References Cited

UNITED STATES PATENTS

| | | | |
|---|---|---|---|
| 2,000,221 | 5/1935 | Dawson | 81/57.16 |
| 3,086,413 | 4/1963 | Mason | 81/57.16 |
| 3,799,009 | 3/1974 | Guier | 81/57.16 |

*Primary Examiner*—James L. Jones, Jr.
*Attorney, Agent, or Firm*—William P. Green

[57] ABSTRACT

A combination tool including a power slip, spinner unit and torque wrench, all mounted movably to a common support structure adjacent a well. The assembly is operable to first support the lower of two successive sections of pipe in the power slip, and then turn the upper section relative to the lower one to screw the pipes together or apart, with the major portion of the rotation being effected by the spinner, and the final high torque make-up rotation or initial joint breaking rotation being produced by the torque wrench.

17 Claims, 21 Drawing Figures

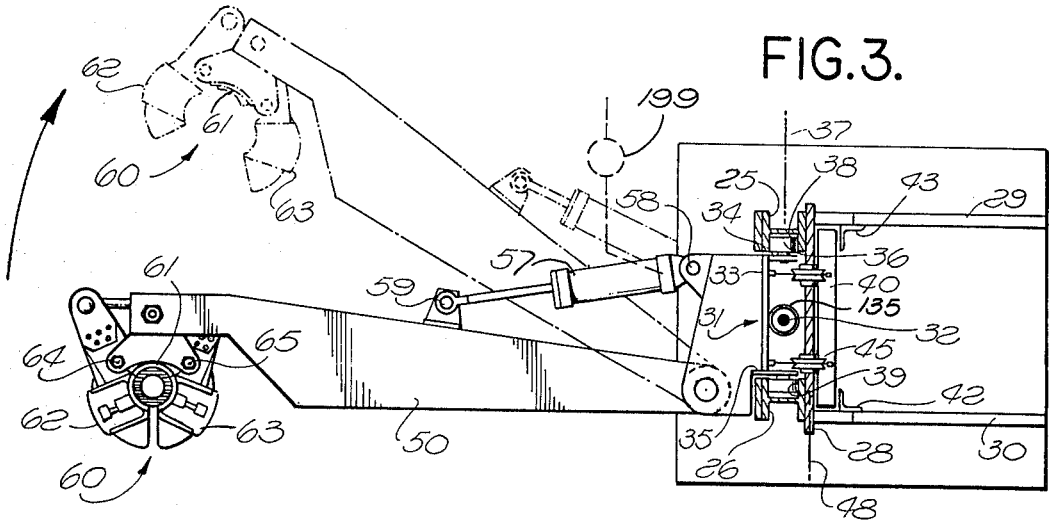
FIG.3.
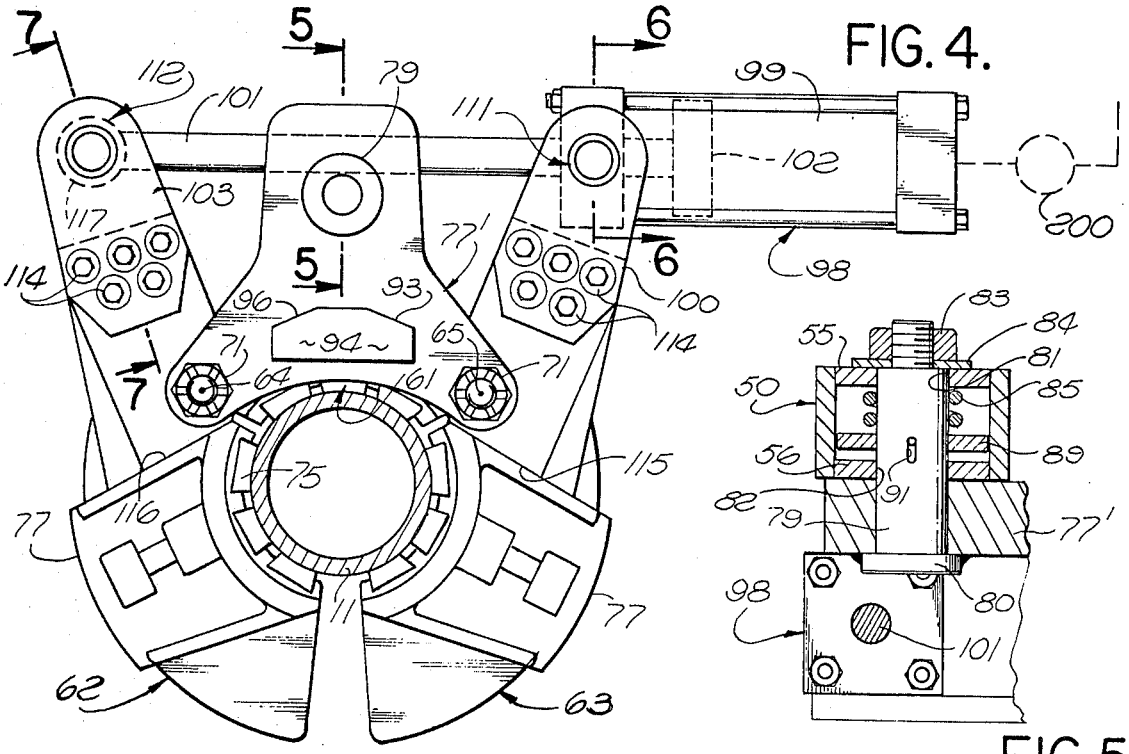
FIG. 4.
FIG.5.
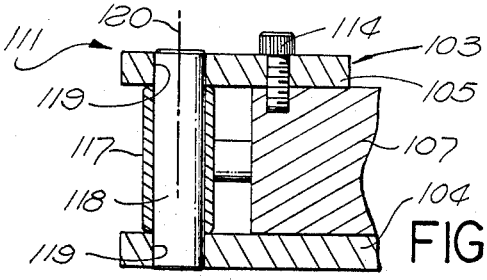
FIG.7.
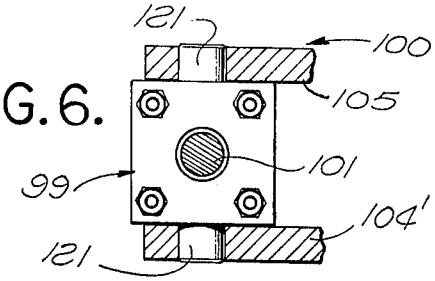
FIG. 6.

TOOL FOR CONNECTING AND DISCONNECTING WELL PIPE

CROSS REFERENCE TO RELATED APPLICATION

This application is a continuation-in-part of my copending application Ser. No. 550,776 filed Feb. 18, 1975 on "Power Slip Unit", now U.S. Pat. No. 3,961,399.

BACKGROUND OF THE INVENTION

This invention relates to improved tools for connecting or disconnecting threaded well pipes.

In running a string of drill pipe or other pipe into or out of a well, a great deal of rig time and effort can be expended in screwing the many threaded connections of the pipe together or apart. At the location of each such connection, a number of steps are required, including first supporting the lower of the two pipes or stands in the rotary table by slips, and then turning the upper pipe relative to the lower one to connect or disconnect the threaded parts. The major portion of this rotation may be effected by a rapidly turning spinner unit, with the last few degrees of make-up rotation or the first few degrees of disconnecting breakaway rotation being produced by a tong or torque wrench mechanism.

In most instances, the slip structure, spinner and tongs or torque wrench have in the past been separate tools, requiring individual manipulation and considerable manual exertion and dexerity in controlling the tools at each threaded joint. U.S. Pat. No. 3,799,009, however, shows a device in which a spinner and torque wrench assembly are mounted to a common support, with the spinner acting to rapidly rotate the upper of two well pipes, and with the torque wrench functioning to exert greater rotative force for completing the final make-up of the joint, or for initially breaking the threaded connection. U.S. Pat. No. 3,514,822 shows a slip installing device which, it is understood, may have been utilized in conjunction with the spinner-tong tool of U.S. Pat. No. 3,799,009, as apparently indicated by an article written by the inventor in the May 1971 issue of *Drilling DCW* magazine. Other combination well tools are shown in U.S. Pats. Nos. 3,086,413 and 3,203,284.

SUMMARY OF THE INVENTION

The major purpose of the present invention is to provide an improved multiple function tool which can perform all of the operations required for connecting or disconnecting two threaded well pipes much more effectively and rapidly than can any prior tool or combination of tools with which we are familiar. The device is installable as a single unit on a well rig, and occupies a minimum of space on the rig floor consistent with the attainment of the desired operational results. In addition, all of the components of the tool can retract laterally when not in use to positions avoiding interference with other operations which must be performed on the well. The tool is purposely designed to enable optimum coordination of all movements of the tool components, well pipe and other equipment in running a string of pipe into or out of a well, with a view toward eliminating all waste motion and thereby minimizing the overall time expended in a round trip or the like.

Structurally, a tool embodying the invention includes a single support structure to which a spinner, torque wrench assembly, and power slip unit are all mounted for appropriate movements relative to the support and relative to one another. The spinner and torque wrench may be interconnected for movement together between active positions about a well pipe and retracted positions offset to a side of the pipe, with the spinner preferably being free for limited upward and downward movement relative to the torque wrench. The spinner desirably includes a series of rollers which are received at different locations about the well pipe, and one or more of which are driven to turn an engaged upper one of two well pipes rapidly in either direction. The torque wrench preferably includes two gripping assemblies which extend about and tightly grip the upper and lower pipe sections respectively, adjacent their threaded connection, and which are power actuable rotatively relative to one another and through a limited angle, but with great torque, to effect the final make-up or initial breakaway rotation of the joint.

Beneath the spinner and torque wrench, there is mounted to the common support structure a slip assembly, which is movable between an active position about the well pipe and a retracted position offset to a side of the pipe, and which is desirably adapted to be clamped tightly against the pipe with a force enabling the slip assembly to be positively moved downwardly relative to the support structure, spinner and torque wrench by movement of the pipe itself, to thereby bring the slips into engagement with a supporting slip bowl structure. The slip assembly is for best results yieldingly urged upwardly relative to the support structure, desirably by a counterbalancing mechanism.

The common support may be an upwardly projecting column located at a side of the well pipe. The apparatus for movably mounting the various pipe engaging elements to this column may include two carriages which are separately movable upwardly and downwardly relative to the support column, with one of the carriages serving to mount the spinner and torque wrench, while the other carriage mounts the slip assembly. The column may be shaped to consist essentially of two spaced structures which are of generally H-shaped horizontal section, to form two inner and outer pairs of vertical channel recesses by which the two carriages respectively are guided for upward and downward movement.

BRIEF DESCRIPTION OF THE DRAWINGS

The above and other features and objects of the invention will be better understoodd from the following detailed description of the typical embodiment illustrated in the accompanying drawings, in which:

FIG. 3 is a plan view of a power slip portion of the tool taken on line 3—3 of FIG. 2;

FIG. 4 is an enlarged horizontal section taken on line 4—4 of FIG. 2;

FIGS. 5, 6 and 7 are fragmentary vertical sections taken on lines 5—5, 6—6 and 7—7 respectively of FIG. 4;

DESCRIPTION OF THE PREFERRED EMBODIMENT

Figure 1:
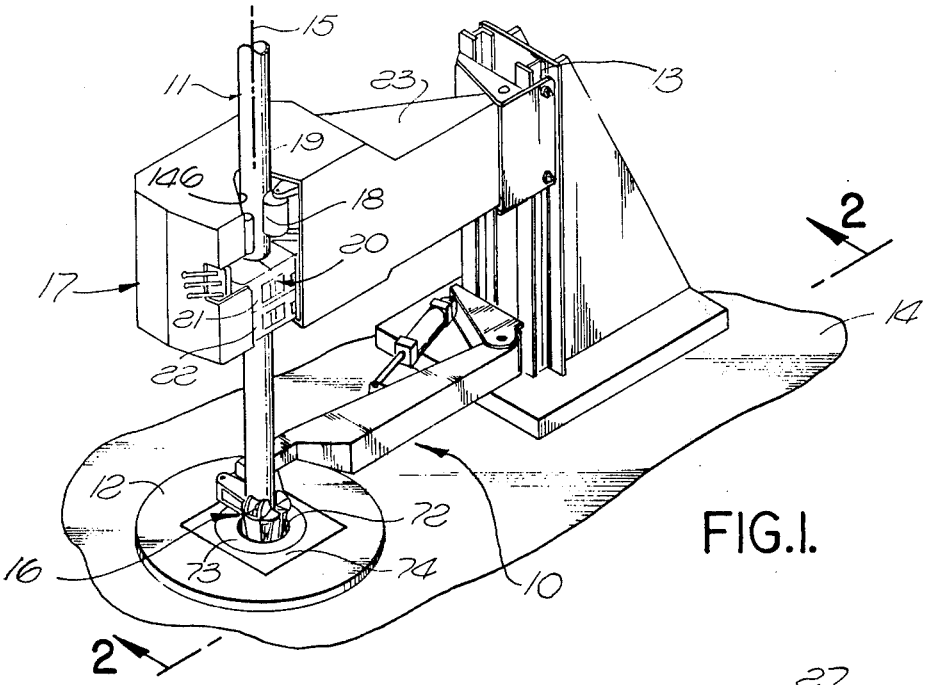
FIG. 1 is perspective view of a well tool constructed in accordance with the invention.

The well tool which is designated generally by the number 10 in FIG. 1 is utilized on a well rig for making and breaking threaded connections in a vertical drill string or other well pipe 11 which extends downwardly through the usual rotary table 12 into the well. Tool 10 includes an upstanding support 13 mounted to the floor 14 of the rig at a location offset to one side of the well pipe 11 and its vertical axis 15. A power slip unit 16, certain features of which have been covered in my copending U.S. application Ser. No. 550,776, is movably mounted to support 13. Above the power slip unit, support 13 carries a pipe turning assembly 17, which includes a spinner 18 for turning an upper joint 19 of the pipe relatively rapidly in making and breaking a connection, and a torque wrench 20 beneath the spinner having upper and lower gripping assemblies 21 and 22 for gripping two successive joints of the pipe and turning them with substantial torque during the final portion of the makeup operation or the inital part of an unthreading operation. The assembly 17 is mounted by an arm 23 to swing laterally between an active position about the pipe and a retracted position offset to a side of the pipe, and for movement upwardly and downwardly with the arm. To permit such swinging movement, the spinner and torque wrench have appropriate openings or gates at one side to pass the drill pipe laterally.

The support 13 may include a base plate 24 which is welded, bolted or otherwise rigidly secured to the rig floor, and which carries two similar spaced vertical upwardly projecting track members 25 and 26, which for their entire vertical height from the level of base plate 24 to their upper extremities 27 (FIG. 2) have the H-shaped horizontal cross-section illustrated in FIG. 3, to thus form a first pair of inner vertical guide grooves or channel recesses 38 and 39, and a second pair of outer grooves or channel recesses 122 and 123 facing away from one another. These track members 25 and 26 may be secured together and reinforced at their rear sides by a vertical plate 28 appropriately welded or otherwise secured to the track members, and by spaced parallel vertical rear supporting plates 29 and 30 secured to plate 28.

A carriage 31 is mounted between tracks 25 and 26 for movement upwardly and downwardly along a vertical axis 32 parallel to the main vertical axis 15 of the well. This carriage 31 may include a front vertical plate 33 secured to a pair of parallel opposite side plates 34 and 35 which rotatably carry vertically spaced pairs of rollers 36 turning about horizontal axes 37 and 37'. These rollers are received within the vertical guideways 38 and 39 formed at the inner sides of track members 25 and 26, and engage the sidewalls of those guideways in a manner guiding carriage 31 for only the desired vertical movement along axis 32.

The carriage 31 and the remainder of the power slip assembly carried thereby are yieldingly urged upwardly relative to column 13 and assembly 17 by counterbalancing means, preferably a counterweight 40, which may be rectangular as shown and be guided for upward and downward movement along a vertical axis 41 parallel to axis 32. This counterweight is slidably received and guided between wall 28 and two vertical angle irons 42 and 43 (FIG. 3) carried by members 29 and 30, with the counterweight being confined laterally by forward portions of the plates 29 and 30. Flexible cables 44 suspend the counterweight, and extend upwardly therefrom and about two pulleys 45 mounted rotatably by a shaft 46 supported by brackets 47 carried by the upper edge of plate 28. These pulleys 45 turn about a horizontal axis 48. After passing about the pulleys, cables 44 extend downwardly to points of connection at 49 (FIG. 2) to the upper edge of carriage 31. The mass of counterweight 40 is sufficient to normally maintain carriage 31 and the entire power slip assembly 16 carried thereby in their upper broken line positions of FIG. 2, in which the entire slip unit is located above the level of the rig floor and is therefore free to swing laterally into and out of engagement with the well pipe.

The slip assembly 16 includes an elongated horizontally extending arm 50 which may be hollow and fabricated of sheet metal top, bottom and side walls cut to give the arm the external shape illustrated in the figures, and welded together along their meeting edges. At one end, this arm is mounted to carriage 31 for horizontal swinging movement between the broken line retracted and full line active positions of FIG. 3, and about a vertical axis 51, relative to the carriage. This pivotal mounting may be attained by providing carriage 31 with three similar vertically spaced horizontal mounting plates 52 (FIG. 2) secured to and projecting forwardly from wall 33 of the carriage, and containing openings through which a vertical pivot pin 53 extends, with the pin also passing through circular openings in portions 54 of the top and bottom walls 55 and 56 of arm 50. A hydraulically actuated piston and cylinder mechanism 57 swings the arm 50 between its two FIG. 3 positions, and may have its cylinder pivoted to plates 52 at 58, and its piston rod pivoted to arm 50 at 59.

Figure 8:
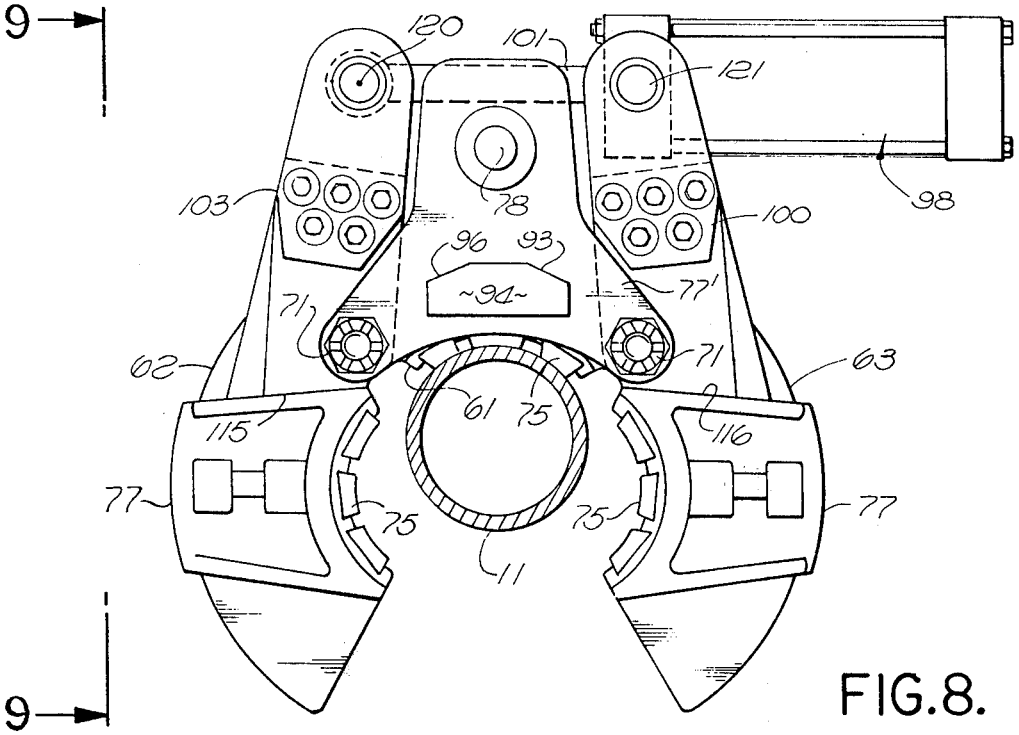
FIG. 8 is a view similar to FIG. 4, but showing the slip assembly in open condition.
Figure 10:
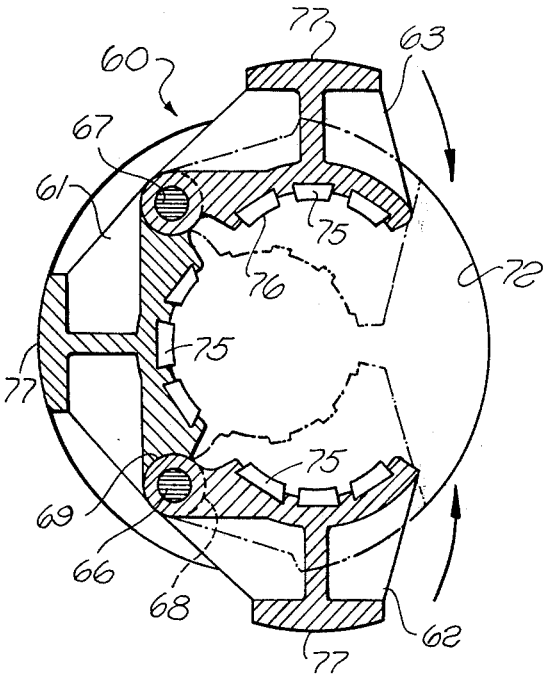
FIG. 10 is a section taken on line 10—10 of FIG. 9.
Figure 9:
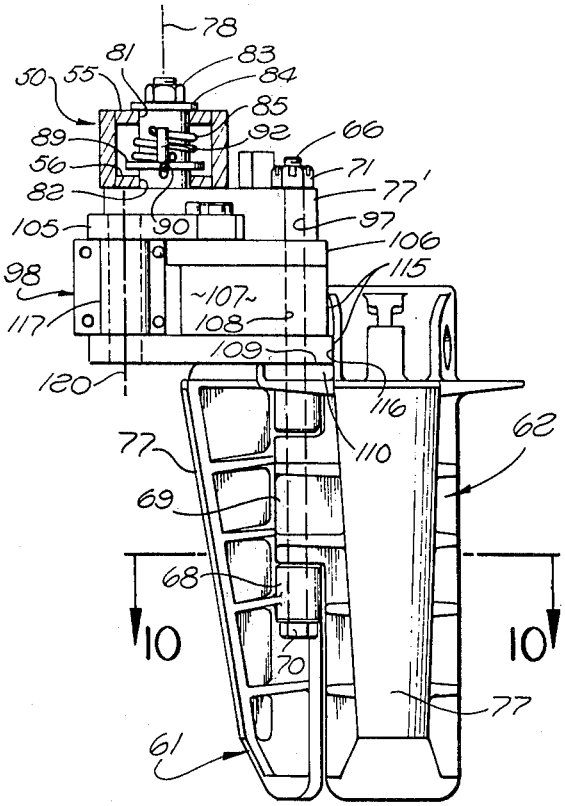
FIG. 9 is a side view of the slip assembly, taken on line 9—9 of FIG. 8.
Figure 11:
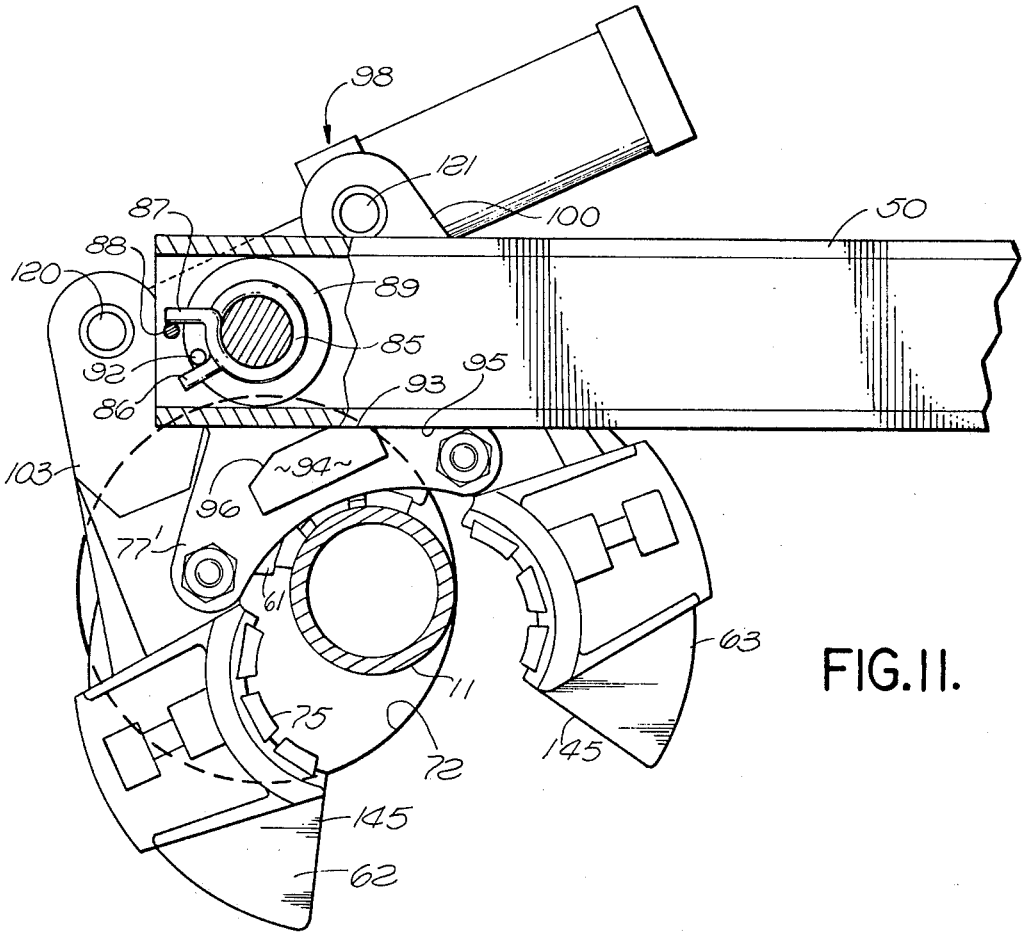
FIG. 11 is a fragmentary plan view, taken primarily on the plane of line 11—11 of FIG. 2, but showing the slips in open condition and deflected laterally for gripping a pipe which is offset to one side of the slip bowl.

At its free end, arm 50 carries a slip assembly 60 preferably including a first central slip 61 and two opposite side slips 62 and 63 pivoted to central slip 61 for relative swinging movement about two parallel vertical axes 64 and 65 between the closed pipe gripping positions of FIGS. 3 and 4 and the open positions of FIGS. 8 and 11. These pivotal connections between the slips are provided by two elongated parallel vertical threaded screws 66 and 67 (FIGS. 8 and 9), each of which extends through a pair of tubular hinge lugs 68 on the center slip 61 and an intermediate tubular hinge lug 69 on one of the side slips 62 or 63, with the hinge screws 66 and 67 being retained by heads 70 at their lower ends and nuts 71 at their upper ends.

The bodies of the three slips are of conventional downwardly tapering wedge-shaped configuration, as shown, to coact with a correspondingly downwardly tapering conical inner surface 72 of a slip bowl 73 supported by a master bushing 74 within the rotary table 12. At their radially inner sides, the three slips carry gripping dies 75 of any conventional type having gripping edges 76 which in the closed FIG. 4 condition of the slips follow essentially the curvature of the outer cylindrical surface of the well pipe, and tightly grip the pipe in a manner preventing relative vertical movement between the pipe and slips. At their radially outer sides, the slips have downwardly concially tapering outer cam surfaces 77 which follow the curvature of and are essentially continuously engageable with slip bowl surface 72 in the closed condition of the slips, to cam the slips inwardly against the pipe in response to exertion of downward force, and thereby support the weight of the pipe from the rotary table in the usual manner.

In order to allow the three slips to turn together through a limited range of movement and to a position such as that shown in FIG. 11 relative to the mounting arm 50, all three of the slips are carried by a mounting part 77' which is connected to arm 50 for pivotal movement relative to the arm about a vertical axis 78. The pivotal connection between these parts includes an externally cylindrical pivot pin 79 (FIG. 5) having a head 80 which is welded to part 77', with the cylindrical shank of the pin projecting upwardly through that part and upwardly thereabove and being journaled rotatably within circular openings 81 and 82 in top and bottom walls 55 and 56 of arm 50. A nut 83 threadedly connected onto the upper end of pivot pin 79 may act downwardly against top wall 55 of arm 50 through a washer 84 to support the pin and slip assembly from the arm. A coil spring 85 disposed about pin 79 at a location within the hollow arm 50 has two outwardly turned arms 86 and 87 (FIG. 11) at its opposite ends which are normally in engagement with opposite sides of an upstanding pin 88 carried by arm 50, to yieldingly hold part 77' and the carried slips in the central position illustrated in FIGS. 4 and 8. The pivot pin 79 carries a ring 89 (FIG. 9), which is secured against rotation relative to pin 79 by a set screw or lock pin 90 extending into a slot or opening 91 in pin 79. The ring 89 rigidly carries an upwardly projecting pin or post 92 which is normally received in aligment with and adjacent the pin 88, and which upon turning movement of part 77' about axis 78 relative to arm 50 acts against one or the other of the spring ends 86 or 87 to move that spring end circularly about axis 78 relative to the other end of the spring. For example, in FIG. 11, pin 92 has moved the spring end 86 in a counterclockwise direction relative to the spring end 87, so that the spring yieldingly resists the turning movement of part 77' from its FIG. 4 centered position to its FIG. 11 position, at which setting the turning movement of part 77' and the carried slips is limited by engagement of a shoulder 93 on part 94 carried by member 77' with a side surface 95 of arm 50. Similarly, swinging movement of part 77' in the opposite direction is limited by engagement of a shoulder 96 on part 94 with the side surface 95 of arm 50.

The center slip 61 is held in fixed position relative to and substantially directly beneath the carrier part 77' by extension of the previously discussed slip hinge screws 66 and 67 through the hinge lugs 68 at the opposite sides of slip 61 and also through vertical openings 97 (FIG. 9) in part 77'.

The two side slips 62 and 63 are power actuated between their open and closed conditions of FIGS. 8 and 4 respectively, and are urged in a closing direction beyond the FIG. 4 condition to tightly grip and clamp inwardly against the pipe, by a fluid actuated piston and cylinder mechansism 98, whose cylinder 99 is pivotally connected to 111 to a clamping arm 100 secured to slip 63, and whose piston rod 101 projecting from piston 102 is pivotally connected at 112 to a clamping arm 103 secured to slip 62. As seen best in FIGS. 3 and 9, the clamping arm 103 may be formed sectionally of a lower essentially horizontal plate 104, two upper plates 105 and 106, and an intermediate block 107, all rigidly secured together in appropriate manner as by a number of screws 114 extending downwardly through these various parts, with parts 104, 106 and 107 containing aligned apertures 108 through which hinge pin 66 extends, and with parts 104, 106 and 107 being confined vertically between part 77' and an upwardly facing surface 109 formed on a flange 110 projecting laterally from and carried by slip 62. The parts 104 and 107 have shoulders 115 which bear against a side surface 116 formed on the top portion of slip 62 in a relation effectively transmitting clamping force from arm 103 to that slip. In addition, arm 103 may be suitably rigidly connected to slip 62 to transmit swinging movement in both directions from the arm to the slip, as by welding these parts together or otherwise interconnecting them.

The pivotal connection 112 between piston rod 101 and clamping arm 103 may be formed by providing the end of the rod with a tubular vertically extending portion 117 received and confined between plates 104 and 105, and disposed about a vertical pivot pin 118 which is retained at its uppper and lower ends within openings 119 in plates 104 and 105. The pivotal axis 120 of this connection between the piston rod and arm 103 extends vertically and parallel to the pipe axis.

The other clamping arm 100 is formed sectionally in the same manner as arm 103, except that arm 100 is a mirror image of arm 103 to properly engage and be connected to the oppositely directed side slip 63. The pivotal connection 111 between cylinder 99 and arm 100 may be formed by providing the cylinder with upper and lower trunnion shafts 121 (FIG. 6) journaled within openings formed in upper and lower plates 105' and 104 of arm 100 corresponding to upper and lower plates 105 and 104 of arm 103.

Figure 2:
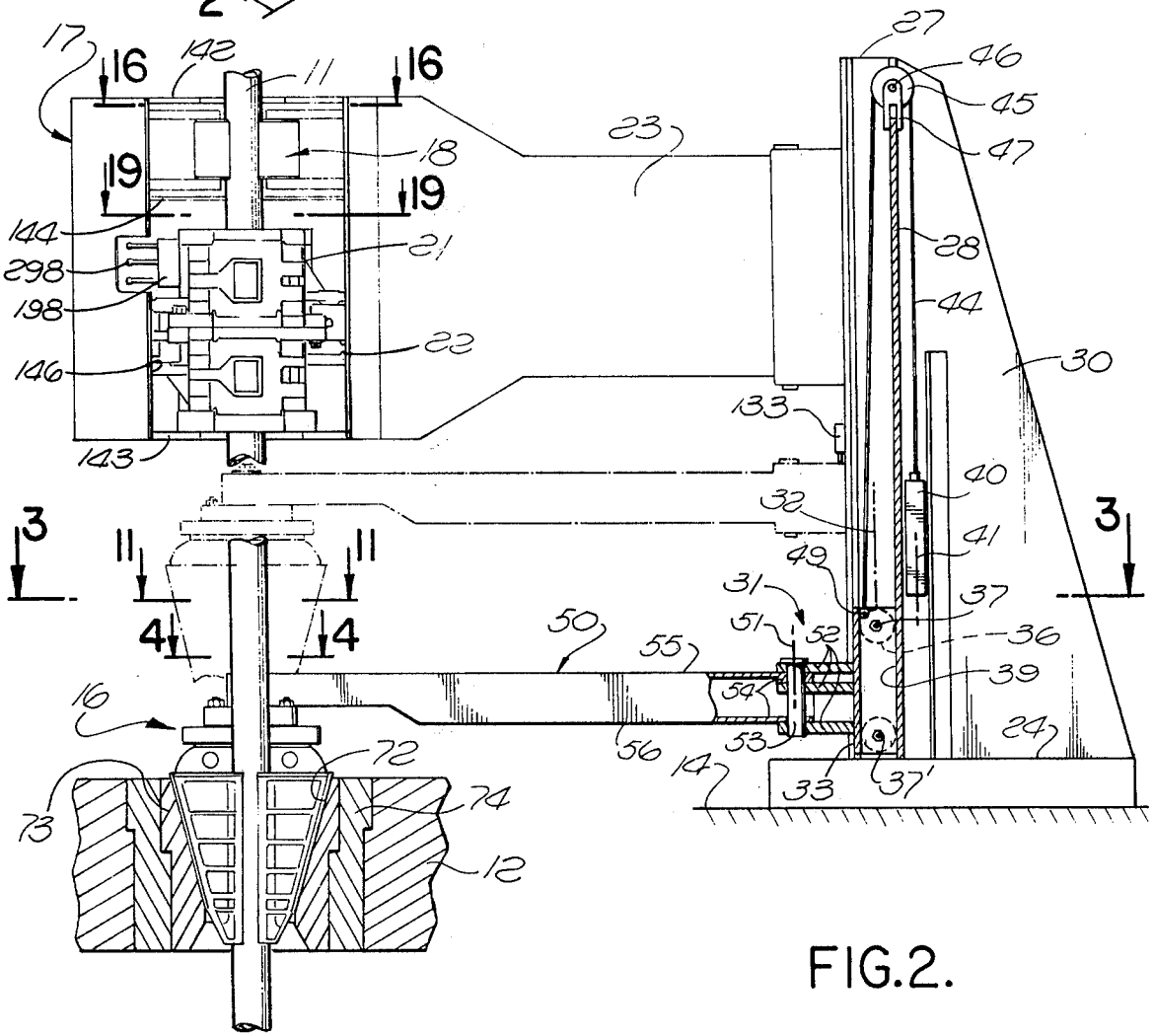
FIG. 2 is an enlarged side view of the tool of FIG. 1, taken on line 2—2 of FIG. 1.

To describe now the mounting for the upper pipe turning assembly 17 of FIGS. 1 and 2, this assembly is carried movably by a second carriage 124 connected to an upper portion of support column 13. As seen best in FIGS. 13, 14 and 15, carriage 124 preferably has a main vertical essentially planar platelike portion 125 bridging across the forward sides of the two vertical track members 25 and 26 of support column 13, and two opposite side portions 126 received at the outer sides of the track structure, opposite the two outer guideway grooves 122 and 123. These two side flanges 126 carry vertically spaced rollers 127 which project into the guide grooves 122 and 123 and are engageable with the side walls of those grooves to guide carriage 124 for only the desired directly vertical movement relative to column 13. The rollers 127 turn about two ver- vertically spaced axes 128 and 129 relative to carriage 124.

Figure 13:
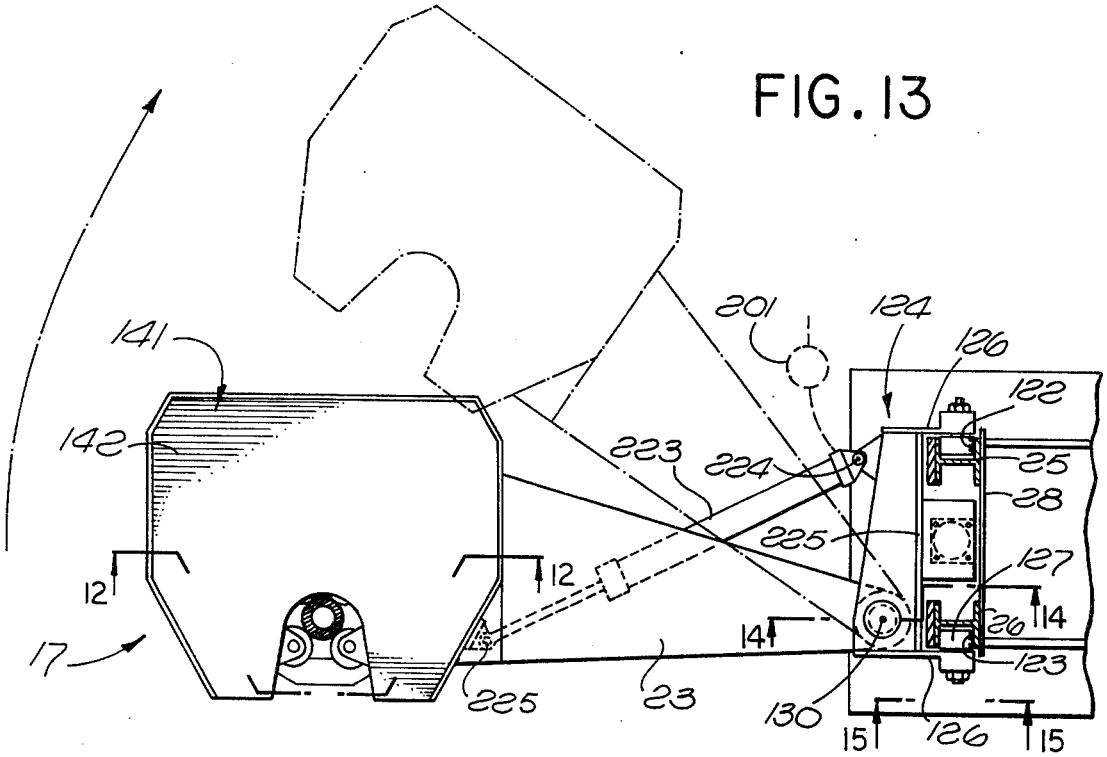
FIG. 13 is a plan view of the entire tool.
Figure 14:
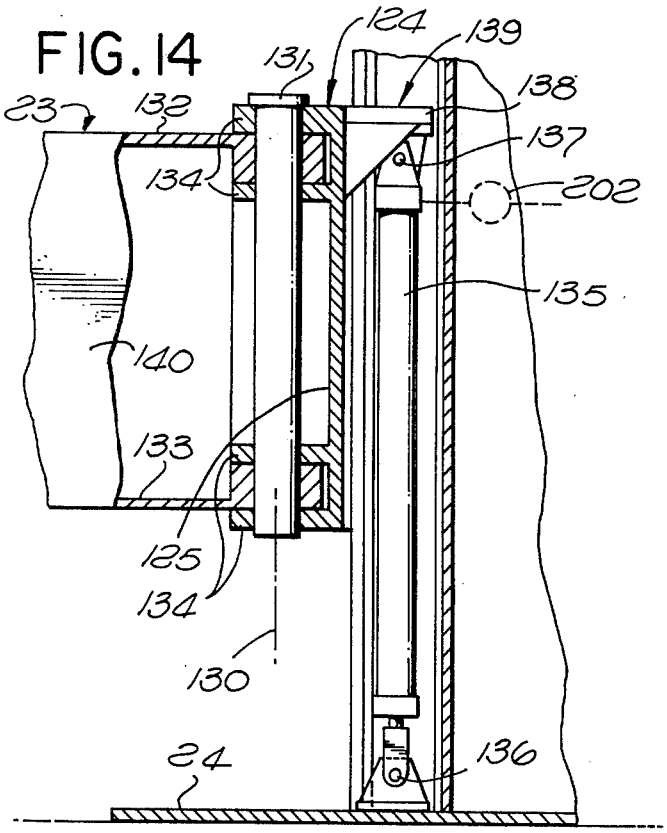
FIGS. 14 and 15 are enlarged fragmentary vertical section taken on lines 14—14 and 15—15 respectively of FIG. 13.

The swinging arm 23 which carries the pipe turning assembly 17 is mounted pivotally to the forward side of vertical wall 125 of carriage 124, for relative swinging movement about a vertical axis 130 between the full line and broken line positions of FIG. 13. This pivotal connection may be formed by providing a pivot pin 131 extending vertically through registering apertures in top and bottom walls 132 and 133 (FIG. 14) of arm 23 and a number of vertically spaced horizontal walls 134 carried rigidly by and projecting forwardly from the vertical wall 125 of carriage 124. As will be apparent from FIG. 14, the confinement of walls 132 and 133 of arm 23 vertically between different ones of the carriage walls 134 effectively supports arm 23 and the carried assembly 17 from carriage 124, while allowing the desired relative pivotal movement. The arm 23 and carried parts are power actuable in both directions about pivotal axis 130 by a piston and cylinder mechanism 223, whose cylinder and piston rod are connected pivotally to carriage 124 and arm 23 respectively at 224 and 225 (FIG. 13).

The carriage 124 and supported parts are power actuable upward and downwardly relative to column 13 and relative to the lower carriage 31 by a piston and cylinder mechanism 135 which extends vertically at the center of the column 13, midway between the H-shaped track elements 25 and 26. This piston and cylinder mechanism 135 may have its piston rod pivotally connected at 136 to base 24 of column 13, and have the upper end of its cylinder connected at 137 to a horizontal plate 138 of a bracket structure 139 rigidly secured to the rear side of plate 125. Admission of pressure fluid to opposite sides of the piston of mechanism 135 will thus serve to power acutate the carriage 124 upwardly or downwardly as desired.

The swinging arm 23 is rigid, and may be hollow and fabricated from a number of sheet metal plates appropriately shaped and welded together, and including in particular horizontal plates forming the discussed top and bottom walls 132 and 133, and one or more interconnecting vertical walls 140.

The pipe turning assembly 17 at the free end of arm 23 is similarly formed of sheet metal plates welded or otherwise fastened together to form a hollow housing 141 having horizontal top and bottom walls 142 and 143 and an intermediate horizontal wall 144, with the housing having a vertically extending opening 146 at one side within which the well pipe 11 is received in the active FIG. 1 position of the tool.

Figure 16:
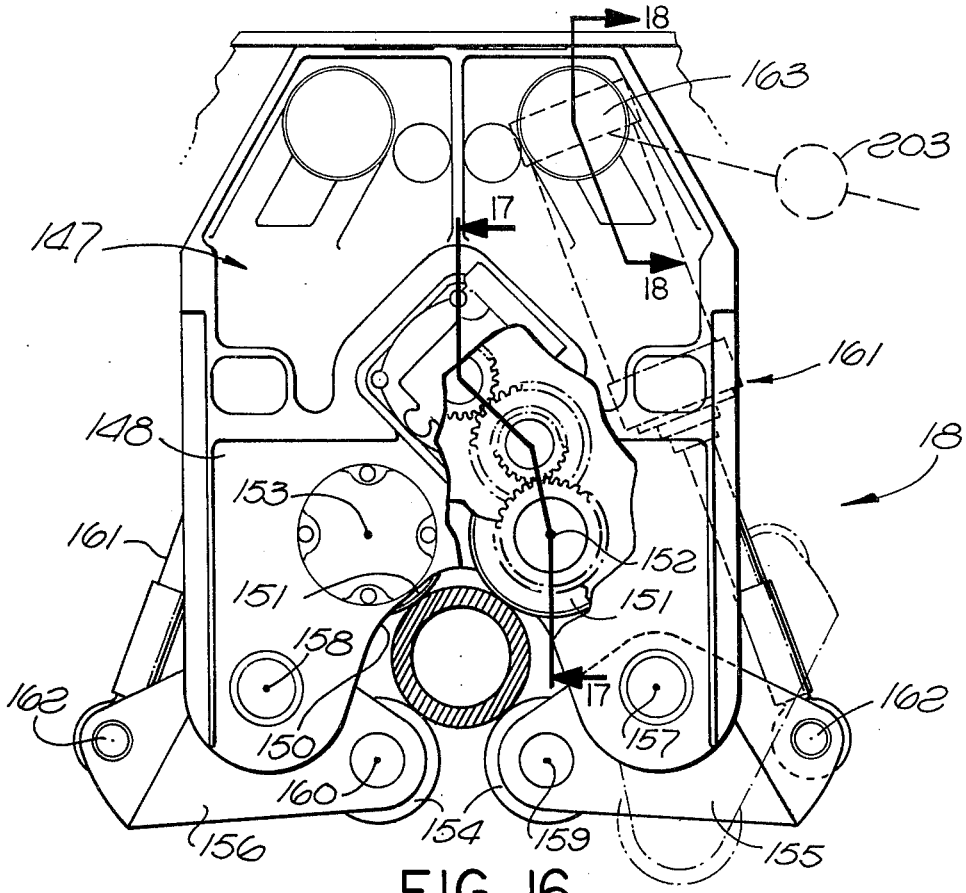
FIG. 16 is an enlarged plan view, partially broken away, of the spinner device, taken primarily on line 16—16 of FIG. 2.
Figure 17:
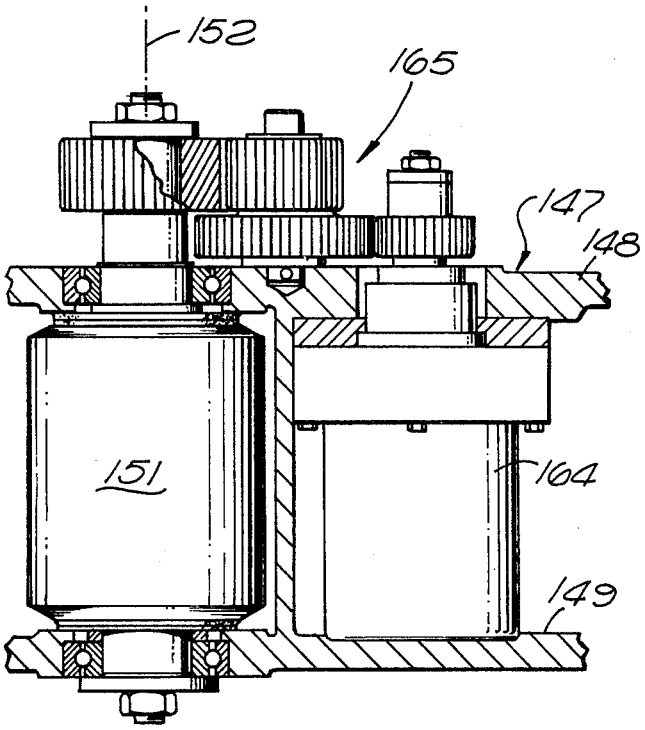
FIGS. 17 and 18 are enlarged fragmentary vertical sections taken on lines 17—17 and 18—18 respectively of FIG. 16.
Figure 18:
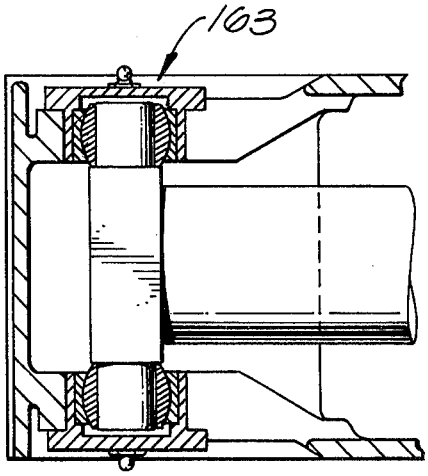

Referring now particularly to FIGS. 16, 17 and 18, the spinner device 18 may be mounted within the upper compartment of housing 141, between walls 142 and 144, and may include a rigid body structure 147 which may be formed sectionally of different parts appropriately shaped and dimensioned to retain the rollers and other elements to be described hereinbelow, and with those sections of the spinner body 147 including top and bottom horizontal walls 148 and 149. These two walls 148 and 149 contain vertically aligned recesses 150 which receive the well pipe in the active position of the spinner, and carry vertically between the two upper and lower walls 148 and 149 two relatively rotatable rollers 151 turning about vertical axes 152 and 153 relative to the body of the spinner. These axes of the rollers are fixed relative to the body of the spinner, as by providing appropriate bearings carried by top and bottom walls 148 and 149 for journalling the rollers. Two additional rollers 154 are mounted to swing between the broken line and full line positions of FIG. 16, to pass a pipe into the spinner in the broken line positions, and tightly grip the pipe between the four rollers in the active full line positions of rollers 154. For this purpose, the two rollers 154 may be mounted to a pair of swinging levers 155 and 156, which levers are pivoted to turn about vertical axes 157 and 158 relative to walls 148 and 149 of the spinner body, with the rollers 154 being mounted to levers 155 and 156 for rotary movement relative thereto about two vertical axes 159 and 160. Two piston and cylinder mechanisms 161 have their rods connected pivotally at 162 to levers 155 and 156, and have their cylinders connected at 163 to the upper and lower walls 148 and 149 of the spinner body, by appropriate pivotal connections such as upper and lower trunnions 262 (FIG. 18), so that fluid actuation of those mechanisms will swing parts 155 and 156 and the carried rollers 154 between their active and retracted positions of FIG. 16.

In the active pipe gripping positions of rollers 154, the engagement of the four rollers with the pipe is with sufficient force to frictionally drive the pipe by powered rotation of the two inner rollers 151 of the spinner. To attain such powered rotation, the spinner body carries a hydraulic rotary motor which is represented at 164 in FIG. 17, and which acts through two similar gear trains one of which is represented at 165 to drive the two rollers 151 is either direction, to thereby correspondingly spin the engaged well pipe in either joint making or joint breaking direction.

The body 147 of spinner 18 is mounted for limited upward and downward movement relative to the surrounding housing 141, and relative to the torque wrench 20 which is carried in the lower portion of the housing. To give the spinner this upward and downward movement, there may be provided within the housing a support structure 166 to which body 147 of the spinner is rigidly connected, and which has portions 167 at opposite sides of the spinner carrying several (typically four) vertical downwardly projecting mounting pins or plungers 168 which are slidably and telescopically received within vertical support tubes 169 secured to housing 141 in a relation guiding the spinner for upward and downward movement while maintaining proper orientation of the spinner and preventing it from turning or cocking relative to the housing. Springs 170 within the tubular guide elements 169 may support the weight of spinner 18 and normally maintain it in the intermediate full line position of FIG. 12, while permitting but yieldingly resisting downward movement from that position to the lower broken line position and also permitting movement upward to the upper broken line position.

Figure 19:
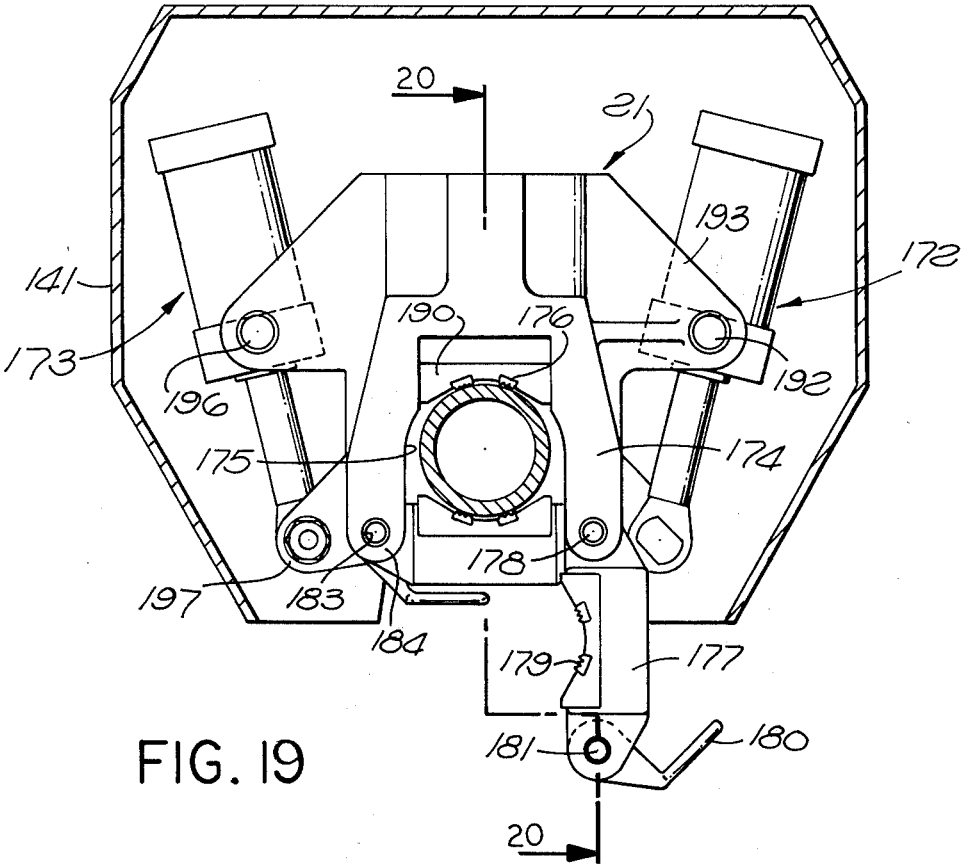
FIG. 19 is an enlarged horizontal section taken on line 19—19 of FIG. 2.
Figure 20:
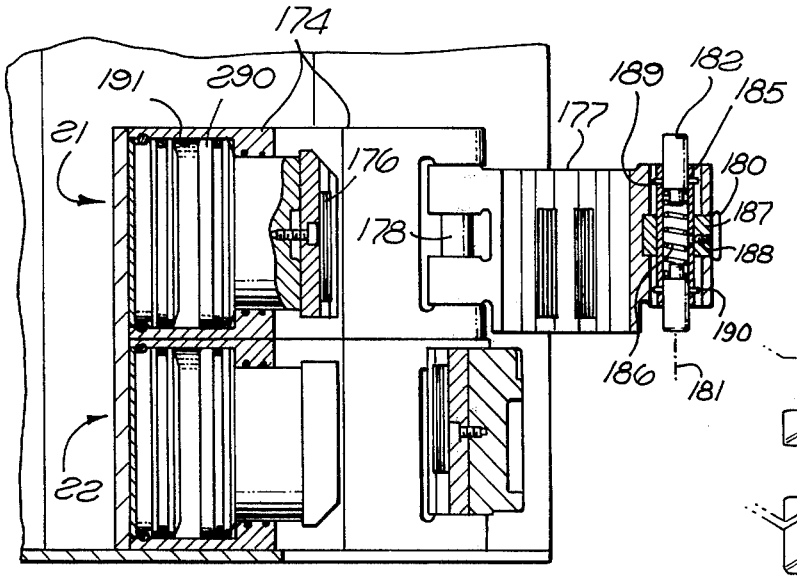
FIG. 20 is a vertical section taken on line 20—20 of FIG. 19.
Figure 21:
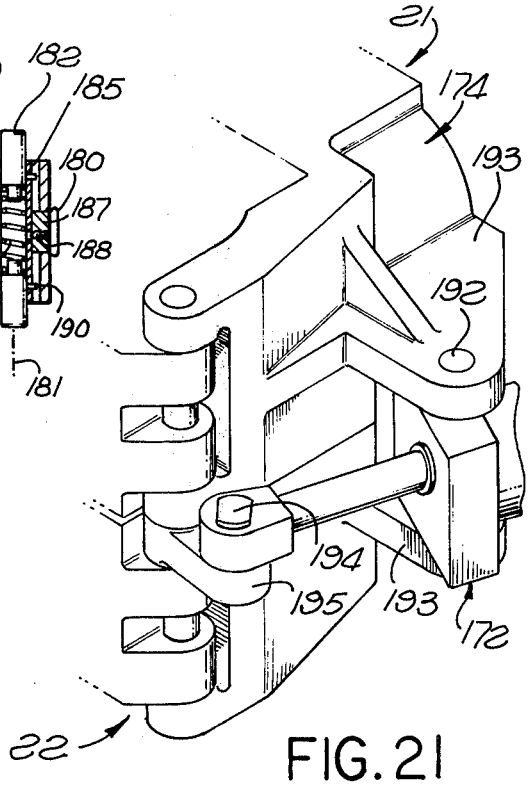
FIG. 21 is a fragmentary perspective view of the torque wrench unit.

As previously mentioned, the torque wrench 20 within the lower portion of housing 141 includes an upper gripping assembly 21 which extends about and grips one of two threadedly interconnected sections of the pipe 11, and a similar lower gripping assembly 22 which extends about and grips the upper end of the lower pipe section, so that upon powered relative rotation of the two sections 21 and 22 through a limited angle, a heavy torque may be applied to the sections for making or breaking the threaded connection therebetween. The upper and lower gripping assemblies 21 and 22 may be considered as essentially identical except with regard to the manner in which they are connected to a pair of actuating piston and cylinder mechanisms 172 and 173, and consequently only the upper of the two assemblies will be described in detail. As seen in FIG. 19, upper assembly 21 includes a main essentially U-shaped body 174 containing a recess 175 which receives the well pipe, and carrying pipe gripping dies 176 for engaging and gripping one side of the pipe in a torque transmitting relation. The outer side of the U-shaped recess 175 is closed by a swinging gate 177, which is pivoted by a pin 178 to swing between the open position in which gate 177 is shown in FIGS. 19 and 20 and a closed position corresponding to that in which the lower gate is shown in those figures. In the closed condition of the gate, the die elements 179 at the inner side of the gate engage the pipe to coact with die elements 176 in transmitting torque from the gripping assembly to the pipe. A locking handle 180 may be mounted to an end of the gate for swinging movement relative thereto, about a vertical axis 181, and may actuate a pair of upper and lower pins 182 vertically into and out of openings 183 formed in the upper and lower portions of a bifurcated end 184 of body part 174 to releasably lock the gate in closed condition. Such actuation of the pins 182 may be attained by providing a vertical cam sleeve 185 about the pins and an intermediate compressed coil spring 186, with handle 180 having a circular portion 187 received about and fixed to the sleeve by a set screw 188, and with the sleeve containing helical cam slots at 189 receiving opposite ends of cam pins 190 fixed to the latch pins 182, so that swinging movement of handle 180 acts through slots 189 to cam pins 182 relatively together and apart.

The die elements 176 carried by body 174 of the gripping assembly 21 may be mounted movably to that body, and in particular may be carried by a piston element 290 mounted in a cylinder bore 191 in the rear portion of body 174, with this piston being fluid actuable to force the gripping die elements 176 tightly against the well pipe.

Figure 15:
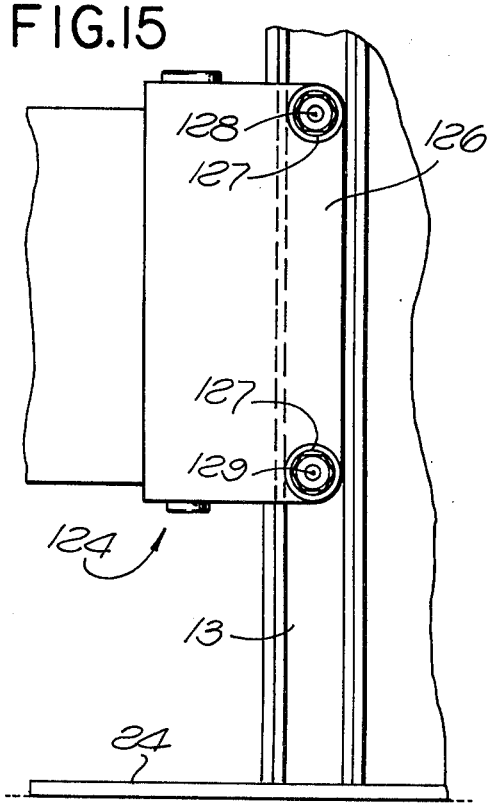

As indicated, the lower gripping assembley 22 has a similar U-shaped body and gate corresponding to elements 174 and 177 of FIG. 15, and when its gate is closed and its piston (corresponding to element 290 of FIG. 20) is actuated, the lower gripping assembly 22 grips the upper end of the lower well pipe section. The lower gripping assembly 22 is mounted stationarily within the lower compartment of housing 141, and is retained against rotation or any other type of movement relative thereto, as by appropriately securing the U-shaped body of the lower gripping assembly in fixed relation to bottom wall 143 of the housing.

The upper gripping assembly is turned in opposite directions about the vertical axis of the well pipe by the two piston and cylinder mechanisms 172 and 173, which are at opposite sides respectively of the gripping assemblies. For this purpose, the cylinder of mechanism 172 is connected by upper and lower aligned vertical trunnion pins or shafts 192 to vertically spaced lugs 193 on the body 174 of upper gripping assembly 21, while the piston rod of the same mechanism 172 is pivotally connected at 194 to a lug 195 projecting laterally from the U-shaped body of the lower gripping assembly, to turn the upper assembly in a predetermined direction relative to the lower assembly upon admission of pressure fluid to mechanism 172. The second piston and cylinder mechanism 173 is connected to the gripping assemblies 21 and 22 in essentially the same manner as assembly 172 but reversely, that is, with the cylinder of mechanism 173 being connected pivotally at 196 to the body of the lower gripping assembly while the piston rod of mechanism 173 is pivotally connected to a lug 197 projecting from the body 174 of the upper gripping assembly 21. The range of turning movement of the upper assembly relative to the lower assembly by the pistons and cylinders may be relatively limited, say for example between 15 and 20 degrees, just sufficient to effectively tighten or loosen the threaded connection between the two pipe sections. The admission of pressure fluid to the actuating cylinders 172 and 173, and to cylinders 191, may be controlled by appropriate valves 198 actuated by manually operated handles represented at 298 in FIGS. 1 and 2.

To describe a cycle of use of the tool, assume that arm 50 and the carried slip assembly are initially in their raised and laterally retracted or inactive positions in which the slips are offset to a side of the well (broken lines in FIG. 3), and assume also that the pipe turning assembly 17 is in a similarly / laterally retracted position. If the device is to be used for disconnecting two vertically successive pipe sections, the operator first actuates the draw works of the ring to raise or lower the two sections to a position in which their threaded connection is spaced a proper distance above the rotary table for contact with the tool, following which he actuates a valve diagrammatically represented at 199 to admit pressurized fluid to the swing cylinder 57, thereby causing that cylinder to commence swing movement of arm 50 and the carried slips from their broken line positions of FIG. 3 inwardly toward the well pipe and the full line positions of FIG. 3. When the slips reach a position in which the center one of the slips 61 engages the pipe, this engagement prevents further movement of slip 61 and arm 50, and thereby causes an increase in pressure in swing cylinder 57, and a valve diagrammatically represented at 200 is actuated to deliver pressure fluid to the outer end of clamping cylinder 98. This pressure causes the clamping cylinder mechanism 98 to force rod 101 of that mechanism outwardly relative to cylinder 99, and thereby clamp slips 62 and 63 toward one another and against the pipe, to the clamped condition of FIG. 4, in which the three slips tightly grip the pipe with a force frictionally locking the slips against upward or downward movement relative to the pipe. The operator then actuates the raising and lowering mechanism of the rig to lower the well pipe far enough to bring the three slips into engagement with slip bowl surface 72, so that the weight of the pipe can thereafter be supported from the slips. During the inward swinging movement of the arm and slip assembly, the slips are located well above the top of the rotary table and the adjacent rig floor, so that the slips may move to positions about the pipe without any interference by the rotary table and other parts.

If during the swinging movement of the slips from their retracted to their active positions, the well pipe is off center with respect to the axis of the well and the slip bowl, as represented in FIG. 11, one of the diverging cam surfaces 145 of the two clamping slips 62 and 63 engages the pipe in a relation turning the entire slip assembly about axis 78 relative to part 77 and arm 50 far enough to enable the pipe to enter the slip assembly between the surfaces 145 of the slips. Because of the manner in which clamping cylinder 98 is connected to slips 62 and 63, it also can swing with these slips about axis 78, and can effectively perform its clamping action even through the well pipe is offset from the main well axis.

Figure 12:
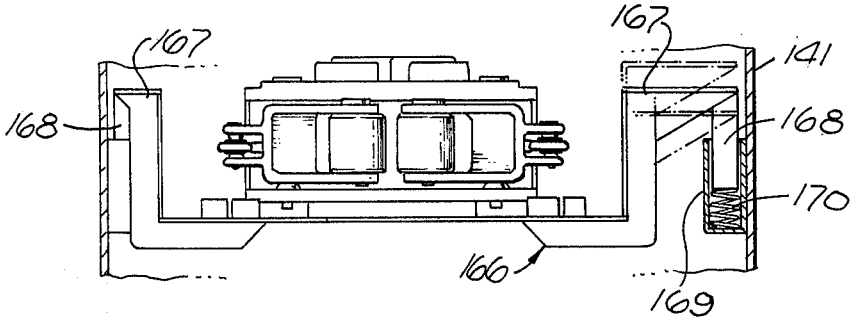
FIG. 12 shows the spinner portion of the tool, primarily in front elevation but with the surrounding housing broken away, the view being taken essentially on line 12—12 of FIG. 13.

After the pipe and slips have reached their FIG. 1 full line positions of support by the slip bowl structure, pressure fluid is admitted to the piston and cylinder mechanism 223 of FIG. 13, through a valve diagrammatically represented at 201, to power actuate housing 141 and the contained parts form the broken line position of FIG. 12 to the full line position of that figure. At the same time, pressure fluid is admitted to cylinder 135 through a diagrammatically represented valve 202, to move carriage 124 upwardly or downwardly as necessary in order to bring the upper gripping assembly 21 of the torque wrench into engagement with the lower end of the upper pipe section, while the lower gripping assembly is brought into engagement with the upper end of the lower pipe section. That is, the plane of separation between the upper and lower gripping assemblies 21 and 22 is brought into horizontal alignment with the plane at which the end shoulders on the two pipe sections meet. With the torque wrench thus located, the operator manually closes the gates 177 of the two gripping assemblies, following which pressure fluid is admitted to cylinder bore 191 of the upper assembly to force piston 190 toward the pipe in a manner gripping the upper pipe section tightly within assembly 21. One of the valves diagrammatically represented at 198 may control this actuation of piston 180, while a second of these valves may admit pressure fluid to the corresponding cylinder bore and piston of the lower gripping assembly 22, to cause it to tightly grip the lower pipe section. After the pipes have been gripped in this manner, the third of the valves 198 is actuated to admit pressure fluid to an appropriate one of the piston and cylinder mechanisms 172 or 173 to turn the upper gripping assembly in a left hand unscrewing direction relative to the lower gripping assembly 22, and thus break the intially tight threaded connection between the two pipes. The upper gripping assembly may then be released from its gripping condition, and pressure fluid may be admitted to spinner 18 to cause it to grip the upper section and rapidly rotate it in an unscrewing direction through several turns to completely disconnect it from the lower pipe section. More specifically, such actuation of the spinner may include first admitting pressure fluid to piston and cylinder mechanisms 161 through a diagrammatically represented valve 203 (FIG.16), to swing rollers 154 into engagement with the pipe, after which pressure fluid is admitted to rotary motor 164 to drive rollers 151 in a proper spinning direction, with the entire spinner being free (by virtue of the mounting provided by elements 168, 169 and 170 of FIG. 12) to move upwardly relative to the torque wrench and the lower pipe as the spinner unscrews the pipe. The disconncted upper pipe joint is then removed and placed in a storage rack or elsewhere, and the remaining pipe is then raised to bring the next threaded joint into proper position for it to be broken in the same manner just discussed. When the pipe which is supported by the slip assembly is raised from its position of support by the slips, the upward movement of the pipe carries with it the slips clamped thereto, with this upward slip movement being enhanced by the counterbalanceing effect of counterweight 40. The slip assembly is ultimately released from its clamping engagement with the pipe by reverse actuation of piston and cylinder mechanism 98, and is then swung laterally to a retracted position by reverse actuation of mechanism 57, while the slip assembly and arm are held in elevated position by the counterweight. The counterweight assures full return of the slips to their uppermost positions as soon as the clamping engagement with the pipe is released.

In running a pipe string into the well, the operations are generally very similar to those discussed above, but with the spinning and torqueing operations being essentially reversed. A lower section of pipe is first supported in the rotary table by swinging the slip assembly into engagement with the pipe, then clamping it tightly against the pipe, and then lowering the pipe to a position of support by the rotary table through the slip bowl structure and slips. The draw works are then operated to bring a next successive pipe into a position above the supported pipe, after which the spinner and torqwue wrench assembly 17 is actuated to a posititon about the pipes if not already at that location, and the spinner is then actuated to grip the upper pipe and turn it in a right hand direction to rapidly screw the upper pipe into threaded connection with the lower pipe. The lower gripping assembly 22 of the torque wrench may grip the lower pipe section and hold it against rotation during this spinning operation. The final make-up torqueing of the joint is effected by causing both of the gripping assemblies 21 and 22 to simultaneously grip their respective upper and lower pipe sections, and then admitting pressure fluid to an appropriate one of the piston and cylinder mechanisms 172 and 173 of the torque wrench to turn the upper gripping assembly 21 in a right hand direction reltive to lower assembly 22 to properly tighten the joint. The spinner and torque wrench may then be released from engagement with the pipe, and retracted laterally if desired, the pipe may be raised upwardly to release the slips from the slip bowl, and the slips may be released from clamping condition about the pipe, following which the connected pipes may be lowered to a position for adding a next successive pipe section to the upper end of the one just added.

While certain specific embodiments of the present invention have been disclosed as typical, the invention is of course not limited to these particular forms, but rather is applicable broadly to all such variations as fall within the scope of the appended claims.

I claim:

1. A well tool for connecting or disconnecting joints in a pipe string which extends downwardly into a well, comprising:

a spinner for gripping an upper one of two threadedly interconnectible pipes of said string rotating it relative to a lower pipe;

a torque wrench including upper and lower gripping assemblies for gripping said upper and lower pipes respectively, and means for turning one of said assemblies relative to the other to tighten or release the threaded connection between said pipes;

a slip assembly for engaging and supporting said lower pipe and including a plurality of slips having outer tapering surfaces engageable with tapering slip bowl structure to support the pipe therein;

a common suport structure for said spinner, torque wrench and slip assembly to be located at a side of the well;

means mounting said spinner and torque wrench to said support structure for upward and downward movement relative thereto and for movement generally horizontally between active positions about the pipes and retracted positions at a side of the pipes; and means mounting said slip assembly to said common support structure for movement between an active position about the lower pipe and a retracted position offset to a side of the pipe and for movement upwardly and downwardly relative to said support structure and relative to said spinner and said torque wrench.

2. A well tool as recited in claim 1, including powered means for clamping said slips against the lower pipe when the slips are in active position, and by force exerted other than through said slip bowl structure, and in a relation securing the slips to said lower pipe for movement upwardly and downwardly therewith relative to said spinner and torque wrench and said slip bowl structure.

3. A well tool as recited in claim 2, including counterbalancing means for yieldingly urging said slip assembly upwardly relative to said spinner and torque wrench.

4. A well tool as recited in claim 1, including counterbalancing means for yieldingly urging said slip assembly upwardly relative to said spinner and torque wrench.

5. A well tool as recited in claim 1, in which said first mentioned mounting means include a carriage mounted to said common supporting structure for upward and downward movemtn, and carrying said spinner and torque wrench, and means mounting said spinner and said torque wrench for movement generally horizontally relative to said carriage and between active and retracted positions.

6. A well tool as recited in claim 1, in which said second mentioned mounting means include a carriage mounted to said supporting structure for upward and downward movement, and means mounting said slip assembly to said carriage and for movement generally horizontally relative thereto between active and retracted positions.

7. A well tool as recited in claim 1, in which said first mentioned mounting means include a first carriage mounted to said common supporting structure for upward and downward movement, and means mounting said spinner and torque wrench to said carriage for movement upwardly and downwardly therewith and for generally horizontal movement between active and retracted positions, and second mentioned mounting means including a second carriage mounted to said common support structure for upward downward movement, and means mounting said slip assembly to said second carriage for movement generally horizontally relative thereto between active and retracted positions.

8. A well tool as recited in claim 1, in which said common support structure includes a column to be mounted at a side of the well and project upwardly; said first mentioned mounting means including a carriage mounted to said column for upward and downward movement relative thereto, and a connection mounting said spinner and said torque wrench to said carriage for movement upwardly and downwardly therewith and for movement generally horizontally relative thereto between active and retracted positions; and second mentioned mounting means of claim 1 including a second carriage mounted to said column for movement upwardly and downwardly relative thereto and relative to said first carriage, and a connection mounting said slip assembly to said second carriage for movement generally horizontally relative thereto between active and retracted positions, and for movement upwardly and downwardly therewith.

9. A well tool as recited in claim 1, in which said common support structure is a column projecting upwardly at a side of the well; said first mentioned mounting means including a first carriage mounted to said column for upward and downward movement relative thereto, and an arm mounted to said carriage for upward and downward movement therewith and for horizontal swinging movement relative thereto and mounting said spinner and torque wrench for generally horizontal swinging movement between active and retracted positions.

10. A well tool as recited in claim 1, in which said common support structure is a column projecting upwardly at a side of the well; said first mentioned mounting means including a first carriage mounted to said column for upward and downward movement relative thereto, and an arm carried by and projecting generally horizontally from said carriage and connected thereto for upward and downward movement therewith and for horizontal swinging movement relative thereto, and mounting said spinner and torque wrench for generally horizontal swinging movement between active and retracted positions; there being powered means for swinging said arm to move said spinner and torque wrench between said active and retracted positions.

11. A well tool as recited in claim 1, in which said common support structure is a column projecting upwardly at a side of the well; said first mentioned mounting means including a first carriage mounted to said column for upward and downward movement relative thereto, and a structure carried by and projecting generally horizontally from said carriage and mounting said spinner and torque wrench for movement generally horizontally relative to said carriage between active and retracted positions; there being powered means for actuating said structure to move said spinner and torque wrench between active and retracted positions; said second mentioned mounting means of claim 1 including a second carriage mounted to said column for upward and downward movement relative thereto and relative to said first carriage, and said spinner and torque wrench, and a structure carrying said slip assembly and mounted to said second carriage for movement relative thereto generally horizontally to move the slip assembly between active and retracted positions; there being counterbalancing means yieldingly urging said second carriage and said carried structure and slip assembly upwardly relative to said first mentioned carriage and said spinner and torque wrench.

12. A well tool as recited in claim 1, in which said common support structure includes a column projecting upwardly at a side of the well; said second mentioned mounting means including a carrage mounted to said column for upward and downward movement relative thereto, and relative to said spinner and torque wrench, and an arm carrying said slip assembly and mounted to said carriage for swinging movement relative thereto to move the slip assembly generally horizontally between active and retracted positions; there being counterbalancing means yieldingly urging said carriage and the carried arm and slip assembly upwardly relative to said column and relative to the spinner and torque wrench.

13. A well tool as recited in claim 1, in which said common support structure is adapted to project upwardly at a side of the well, and forms a first pair of generally vertical outer guide recesses facing essentially away from one another, and a second pair of generally vertical inner guide recesses facing essentially toward one another and located between said outer recesses; said first mounting means including a first carriage guided by one of said pairs of recesses for upward and downward movement relative to said support structure, and means mounting said spinner and torque wrench to said first carriage for movement upwardly and downwardly therewith and for movement generally horizontally relative thereto between active and retracted positions; said second mounting means including a second carriage guided by the other of said pairs of recesses for upward and downward movement relative to said support structure and relative to said first carriage, and means mounting said slip assembly to said second carriage for movement upward and downwardly therewith relative to said second carriage and said spinner and torque wrench and for movement generally horizontally relative to said second carriage between active and reactive positions.

14. A well tool as recited in claim 1, in which said common support structure includes a column to project upwardly at a side of the well and having two laterally spaced guide portions of essentially H-shaped horizontal section defining two generally vertical outer channel recesses facing away from one another and two generally vertical inner channel recesses facing essentially toward one another between said outer recesses; said first mounting means including a carriage carrying rollers projecting into said outer channel recesses and guided thereby to mount the carriage for upward and downward movement relative to said column, a struture mounted to said carriage for pivotal movement relative thereto about a vertical axis offset to a side of the well and carrying said spinner and torque wrench for swinging movement relative to the carrier.

15. A well tool as recited in claim 14, in which said second mounting means include a second carriage having a portion received between said H-shaped portions of the column and carrying rollers projecting into said inner channel recesses and guided thereby for upward and downward movement of the second carriage, an arm mounted to said second carriage for swinging movement about a vertical axis and carrying said slip assembly for movement upwardly and downwardly with said second carriage and for swinging movement between active and retracted positions, and counterbalancing means yieldingly urging said second carriage upwardly relative to said first carriage and said column.

16. A well tool as recited in claim 15, in which said first mentioned mounting means of claim 1 include means mounting said spinner for limited upward and downward movement relative to said torque wrench.

17. A well tool as recited in claim 1, in which said first mentioned mounting means include means mounting said spinner for limited upward and downward movement relative to said torque wrench.

* * * * *